106-18.23

SR

XR 4,029,585

IX 201DV

United State

Dettre et al.

1] 4,029,585

5] June 14, 1977

[54] AQUEOUS DISPERSIONS OF PERFLUOROALKYL ESTERS FOR TREATING TEXTILES

[75] Inventors: Robert Harold Dettre, Wilmington; Edward James Greenwood, Newark, both of Del.

[73] Assignee: E. I. Du Pont de Nemours and Company, Wilmington, Del.

[22] Filed: Aug. 7, 1975

[21] Appl. No.: 602,902

Related U.S. Application Data

[62] Division of Ser. No. 382,843, July 26, 1975, Pat. No. 3,923,715.

[52] U.S. Cl. ..... 252/8.6; 106/15 FP; 260/475 F; 260/485 F; 427/372 R; 427/375; 428/421

[51] Int. Cl.[2] ..... D06M 13/16; D06M 13/20

[58] Field of Search ..... 252/8.6, 8.8; 106/15 FP; 260/29.6 R, 29.6 F, 29.6 M, 29.6 N, 475 F, 485 F; 427/372, 375; 428/421

[56] References Cited

UNITED STATES PATENTS

| | | | |
|---|---|---|---|
| 3,121,688 | 2/1964 | Daly, Jr. et al. | 252/33.4 |
| 3,484,281 | 12/1969 | Guenthner et al. | 428/421 |
| 3,794,623 | 2/1974 | Kleiner et al. | 260/485 F X |
| 3,819,668 | 6/1974 | Jaeger | 260/408 |
| 3,860,613 | 1/1975 | Jaeger | 260/485 F X |
| 3,868,408 | 2/1975 | Holland et al. | 260/485 F |
| 3,870,748 | 3/1975 | Katsushima et al. | 260/475 F |
| 3,916,009 | 10/1975 | Jager | 260/485 F |
| 3,916,053 | 10/1975 | Sherman et al. | 428/96 |
| 3,920,561 | 1/1975 | Des Marais | 252/8.8 |

FOREIGN PATENTS OR APPLICATIONS

| | | |
|---|---|---|
| 1,065,033 | 4/1967 | United Kingdom |
| 1,288,719 | 9/1972 | United Kingdom |

*Primary Examiner*—John C. Bleutge
*Assistant Examiner*—T. DeBenedictis, Sr.
*Attorney, Agent, or Firm*—James A. Costello

[57] ABSTRACT

Dry soil resistance and nonflame propagating characteristics are insured in textile fibers by applying thereto an aqueous dispersion containing a perfluoroalkyl ester of a carboxylic acid of from 3 to 30 carbon atoms. After the dispersion is applied, the fibers are dried at between 120° to 170° C.

2 Claims, No Drawings

4029585
OR IN 252/8.6

AQUEOUS DISPERSIONS OF PERFLUOROALKYL ESTERS FOR TREATING TEXTILES

CROSS-REFERENCE TO RELATED APPLICATION

This is a division of copending patent application bearing U.S. Ser. No. 382,843, filed on July 26, 1973, now U.S. Pat. No. 3,923,715.

BACKGROUND OF THE INVENTION

This invention concerns the application of aqueous dispersions of certain perfluoroalkyl esters to textile fibers followed by drying. The fibers are thus invested with a coating that is resistant to dry soiling and that does not propagate a flame.

Polymers and other compounds containing highly fluorinated segments are widely used for providing oil and water repellency to textile substrates. When applied to carpets of synthetic, thermoplastic fibers such as polyesters, polyamides, and polyacrylics, fluoropolymeric coatings such as the polymers of perfluoroalkylacrylates and methacrylates provide a degree of resistance to dry, traffic-caused soiling. While carpets of the aforementioned thermoplastic polymers do not burn readily in uncoated form, the coated fibers may support the advance of a flame as from a dropped match, and, if they do, cannot be tolerated for commercial or home carpeting use. The susceptibility of treated fiber carpets to burning is particularly noticeable when the carpet construction is of the loose or shag type.

The Pill Test

The Department of Commerce of the United States Federal Government has published an official test (the pill test) for testing surface flammability of carpets and rugs. This test method is found in the Federal Register, Vol. 35, No. 74 - Thursday, Apr. 16, 1970, and it has been used during the development of the instant invention for evaluating the effect on the flammability of carpet fibers when they are coated with the compositions of interest. In this test a standard size piece of carpet is exposed in a controlled environment to an ignited methenamine tablet. The test is continued until the last vestige of flame or glow disappears, or until the flaming or smoldering has progressed to within one inch of an arbitrary circle 8 inches in diameter centered at the point of ignition. Eight specimens of each material are tested, and for seven of the eight the charred area must not extend to within the prescribed distance of the circle if the carpet flammability is to be graded acceptable.

While the grading of the test is specified as depending on the distance traveled by the burning, further knowledge can be gained about the burning characteristics of carpets through observation of the relative area burned and by the rate of burning.

It has now been found that a class of highly fluorinated compounds can provide superior dry soil resistance and still preserve the same resistance to burning possessed by the uncoated fibers. The useful fluorinated compounds are mono- and polycarboxylic acid esters which volatilize at or near the melting point of the thermoplastic substrate.

SUMMARY OF THE INVENTION

This invention concerns an aqueous dispersion of a composition consisting essentially of a perfluoroalkyl ester of a carboxylic acid of from 3 to 30 carbon atoms, the ester being volatile at about 200° to 300° C., the composition forming up to about 60% of the total weight of the dispersion.

This invention is also concerned with thermoplastic fibers coated with the composition as well as with the process for applying the aqueous dispersion uniformly to the surface of the fibers, followed by drying the fibers at about 120° to 170° C.

DETAILS OF THE INVENTION

Many of the known esters of fluorinated alcohols and organic acids are useful in the compositions of the invention. Representative of the fluorinated alcohols that can be used are $(CF_3)_2CFO(CF_2CF_2)_pCH_2CH_2OH$ where $p$ is 1 to 5; $(CF_3)_2CF(CF_2CF_2)_qCH_2CH_2OH$ where $q$ is 1 to 5; $R_fSO_2N(R')CH_2CH_2OH$ where $R_f$ is perfluoroalkyl of 4 to 12 carbons and R′ is H or lower alkyl; $C_nF_{2n+1}(CH_2)_mOH$ or —SH where $n$ is 3 to 14 and $m$ is 1 to 12; $R_fCH_2C(X)H(CH_2)_rOH$ where $r$ is > 1 and X is $—O_2C$-alkyl, $—(CH_2)_sOH$, $—(CH_2)_sO_2C$ alkyl or —OH wherein $s$ is an integer of 0 to 10 and $R_f$ is perfluoroalkyl of 3 to 21 carbons; $R_fCON(R)(CH_2)_tOH$ where $R_f$ is perfluoroalkyl of 4 to 18 carbons, $t$ is 2 to 6 and R is an alkyl group of 4 l to 10 carbons.

The preferred fluorinated esters utilize perfluoroalkyl aliphatic alcohols of the formula $C_nF_{2n+1}(CH_2)_m$-OH where $n$ is from about 3 to 14 and $m$ is 1 to 3. Most preferred are esters formed from a mixture of the alcohols where $n$ is predominantly 10, 8 and 6 and $m$ is 2. These esters can be formed by reacting the alcohol or mixture of alcohols with mono- or polycarboxylic acids which can contain other substituents and which contain from 3 to 30 carbons. In one method of preparing the esters, the alcohol is heated with the acid in the presence of catalytic amounts of p-toluenesulfonic acid and sulfuric acid, and with benzene, the water of reaction being removed as a codistillate with the benzene. The residual benzene is removed by distillation to isolate the ester. Table I below lists a representative group of esters so prepared, with pertinent physical properties. The perfluoroalkyl group in these esters is $C_nF_{2n+1}(CH_2)_m$- as indicated above, where $n$ is 6 to 14 and $m$ is 2.

TABLE I

| Perfluoroalkylethyl Ester of | Ester number (Theory) | Acid No. | Melting Range (° C) |
|---|---|---|---|
| a. Acetic acid | 102 (106) | 0.5 | 23–24 |
| b. Octanoic acid | 95.9 (91.5) | 1.3 | 33–35 |
| c. Decanoic acid | 91.8 (87.6) | 0.5 | 30–32 |
| d. Lauric acid | — | — | 35–38 |
| e. Palmitic acid | — | — | 49–50 |
| f. Delta-chlorovaleric acid | — | 1.2 | 40–42 |
| g. Oleic acid | 78 (75) | 3.0 | 28–30 |
| h. Linoleic acid | 79.4 (74.9) | 4.3 | 22–27 |
| i. Malonic acid | 114 (108) | 0.1 | 31–33 |
| j. Succinic acid | 112 (106) | 0.9 | 35–38 |
| k. Adipic acid | 109 (103) | 0.7 | 35–38 |
| l. Suberic acid | 107 (101) | 1.3 | 43–48 |
| m. Sebacic acid | 104 (98) | 3.1 | 45–52 |
| n. Dodecanedioic acid | 103 (96) | 1.5 | 52–58 |
| o. Tridecanedioic acid | 119 (95) | 1.7 | 51–54 |
| p. Maleic acid | 119 (106) | 0.9 | 28–32 |
| q. Azelaic acid | 107 (100) | 0.5 | 35÷39 |
| r. Itaconic acid | 101 (105) | 1.9 | 45–48 |
| s. Benzyl malonic | 91 (99) | 0.2 | 40–42 |
| t. o-Phthalic acid | 101 (101) | 0.3 | 25–27 |
| u. d,l-Camphoric acid | — | 1.7 | 34–36 |
| v. Citric acid | 93 (100) | 4.8 | 42–48 |

The 2-perfluoroalkyl ethanols of the formula $C_nF_{2n+1}CH_2CH_2OH$ wherein $n$ is from 6 to 14, and preferably a mixture of 2-perfluoroalkylethanols whose values of $n$ are as described above can be prepared by the known hydrolysis with oleum of 2-perfluoroalkylethyl iodides, $C_nF_{2n+1}CH_2CH_2I$. The 2-perfluoroalkylethyl iodides can be prepared by the known reaction of perfluoroalkyl iodide with ethylene. The perfluoroalkyl iodides can be prepared by the known telomerization reaction using tetrafluoroethylene and thus each perfluoroalkyl iodide differs by $-(CF_2-CF_2)-$ unit.

To produce the compounds used in the process of the present invention wherein the number of carbon atoms in the perfluoroalkyl portion of the molecule is in the range of 6 l to 14, removal of perfluoroalkyl iodides boiling below about 116°–119° C. (atmospheric boiling point of $C_6F_{13}I$) and above about 93° C.–97° C. at 5 mm. pressure (5 mm. pressure boiling range of $C_{14}F_{29}I$) is carried out. This yields a mixture of perfluoroalkyl iodides wherein the number of carbon atoms in the perfluoroalkyl portion of the molecule is in the range of 6 to 14 carbon atoms. Another method for preparing esters employed in the instant invention is to react perfluoroalkylethyl bromides or iodides with an alkali metal carboxylate in an anhydrous alcohol.

A preferred fluoroester for use in the compositions of the invention is the citric acid ester listed at v in Table I. Also preferred is the citric acid urethane. Therein, the citric acid ester is modified by reacting the ester with an isocyanate compound, for example, 1-methyl-2,4-diisocyanatobenzene, which reacts with the —OH group of the citric acid ester to form urethane linkages. This product, whose preparation is shown in Example 2 herein has sufficient volatility to be removed at a temperature of about 300° C., and provides good soil repellency on polyester and polyamide carpets. It is especially valuable because it seems to resist removal by abrasion better than many other fluororepellents.

While the invention is not limited to the operation of a particular theory, it is hypothesized that the enhanced burning of synthetic polymeric floor coverings when treated with fluorinated polymers is due to a lowering of the surface tension of the melted polymer, which thus reduces the rate of drawback from the flame front during burning. Where the fluoro repellent compound is sufficiently volatile during burning, it is thereby removed, and does not lower the surface tension of the melted material, thus preserving its flame resistant character.

As indicated, the fluorinated esters useful in the invention are those which volatilize at about the melting point of the substrate. Practically speaking this means volatile at about 200° C. to 300° C. and a simple test has been defined for this determination. The test depends also on the fact that fluorinated esters having $(CF_3)$ $(CF_3)CF$-, or, $CF_3$-$CF_2$-$CF_2$—, segments exhibit surfactant qualities particularly in oily media.

In this test a tuft of treated carpet weighing about 0.05 g. is placed on a glass slide and inserted into a tube furnace at 450°–550° C. for 10 to 20 seconds. During the few seconds in the furnace the fibers in the tuft melt and coalesce into droplets on the slide. After cooling to 25° C. the hexadecane contact angle is measured on the solidified droplet. If the fluorinated ester treatment is surface active in the polymer, thereby lowering its surface tension and is also stable to the test conditions of temperature and time, then the hexadecane contact angle on the solidified droplet will be somewhat higher than the angle observed on a solidified droplet obtained by applying the test to a tuft from an untreated carpet. Esters which are not volatile in this test are not useful in this invention.

Of course, esters that volatilize at a low temperature, room temperature for instance, would not be useful either, since they would not provide the desired soil repellency for any reasonable period of time. When fluorinated esters useful in the invention are heated at temperatures of 250° to 300° C. they volatilize slowly, and at about 300° C. are completely removed. Fluorinated acrylate and methacrylate polymers, such as polymerized $CF_3(CF_2)_8CH_2CH_2OOC$-$CH{=}CH_2$ do not generally volatilize completely until temperatures of about 400° C. are attained. When tested in an oven at about 500° C. as described in the test conditions, polymers of this kind do not volatilize significantly even after 35 seconds in the oven. The test thus serves very satisfactorily to distinguish those compounds which will volatilize at the usual synthetic carpet fiber melting temperatures of 200° to 300° C.

The fluorinated esters can be applied to synthetic thermoplastic fibers such as polyester and polyamide fibers in any known manner so as to leave from about 0.01% to 1.0% of the ester on the fibers, based on dry fiber weight. In one method of application an aqueous treating dispersion can be prepared as follows: The ester is liquefied by mixing with a small amount of volatile solvent such as methyl isobutyl ketone or the like, and the product dispersed in water containing a little emulsifying surfactant such as a tetraalkylammonium halide to make a composition containing, typically, about 10% ester. This aqueous dispersion can be extended in water for application to a textile substrate such as a synthetic fiber carpet. Spray application, dipping and wringing, curtain coating or the like can be employed to coat the fibers uniformly with the dispersion, followed by drying at about 120°–170° C.

Treated carpets exhibit outstanding dry soil resistance in wear tests. Such tests involve exposure of a group of carpet pieces, both treated and untreated, to normal foot traffic in a known environment. The relative position of the test pieces is changed at regular intervals, usually every day, in order to ensure equal exposure of all pieces. The pieces are vacuum cleaned once a day, all in exactly the same manner. After 10,000 people have walked over the carpet pieces (by automatic count), the pieces are examined and graded visually on a scale of 0 to 100 compared to the appearance of a similar carpet which has been processed in the same manner as the treated carpet pieces, but without any repellent present during the treatement (water-treated control).

The water present during this control treatment removes any soluble material from the fibers in the same way that the aqueous repellent application does for the repellent treated samples. The numbered ratings have the following meaning:

0 - worse than water treated control
50 - equal to control
70 - slightly better than control
80 - noticeably better than control
90 - considerably better than control
100 - extremely slight soiling The differences are quite easily discernible with the indicated amount of traffic which, for the tests reported herein, took about two weeks to complete.

The aqueous dispersion of fluorinated ester can be blended with an aqueous latex of polymethyl methacrylate to make a composition which is extendible in water, and can be diluted therewith for application to textile substrates. The dispersion before dilution will normally contain from about 5% to 15% of the fluorinated ester and 3% to 30% of the methyl methacrylate polymer.

For application to textile substrates such as carpets the above described dispersion is diluted still further with water. The application can be made in any known manner as already described for application of the fluorinated esters themselves. Significant soil repellency is achieved with at least about 0.1% of the fluoroester on the fibers, based on fiber weight. Amounts greater than 1% do not seem to improve repellency significantly. The presence of the methacrylate polymer improves soil repellency and particularly enhances the durability of the treatment on the fibers. The methacrylate polymer should be present in not more than about 3% based on fiber weight. Higher loadings tend to increase flammability as indicated by char length in the Pill Test.

After the composition has been applied to the carpet it is dried and cured on the fibers by passing the carpet through an oven, exposing it to temperatures of about 120° C. to 170° C. for about 5 to 10 minutes.

The repellency tests applied to treated and untreated carpet pieces in the following examples were: Water Repellency Spray Test No. AATCC 22-1964; Oil Repellency Test No. AATCC 118-1966T.

The following Examples are intended to illustrate the invention. They are not meant to limit the invention. Unless otherwise indicated, all quantities are by weight.

EXAMPLE 1

Perfluoroalkylethanol (4765 g.) which was a mixture of 2-perfluoroalkylethanols containing 8 to 16 carbon atoms (6 to 14 carbon atoms in the perfluoroalkyl portion of the molecule) and whose average molecular weight was 487, stearic acid (2845 g.) and benzene (1250 g.) were placed in a reaction flask. The charge was slowly heated and when the temperature was about 55° C., p-toluenesulfonic acid (0.8 g.) and sulfuric acid (96%, 6.5 g.) were added to the flask. Heating was continued and at about 87° C., benzene began to reflux and water was separated from benzene in a modified Dean Stark trap wherein the benzene was returned to the flask. The pot temperature gradually rose to 109° C. over an 11 hour reaction period, during which time water was continuously removed. The reaction mass was then cooled to about 95° C. and 440 g. of 10% sodium carbonate solution was slowly added over a period of about two hours. The reaction mass was again heated to remove water and the residual benzene was removed at around 88° C. at 20 mm. Hg. pressure. The reaction mass was filtered at around 90° C. to yield 6944 g. (93% yield) of 2-perfluororalkylethyl stearate. The product was light tan solid and melted in the temperature range of 42° to 48° C. Ester Number found 76.0, 75.6; Calculated 72.0; Acid Number found 0.03, 0.03; Calculated 0.

EXAMPLES 2, 3 AND COMPARISONS A and B

EXAMPLE 2

Into a reaction flask were charged 50 parts of the perfluoroalkyl ester of citric acid listed at v in Table I and 2.8 parts of 1-methyl-2,4-diisocyanatobenzene. The mixture was heated gently until molten, then 0.05 part of butyl tin trichloride was added and the charge heated to 100° C. and held for 1 hour. The temperature was then adjusted to 80° C. and held there during the remainder of the reaction. After 4 hours at 80° C. another 0.05 part of butyl tin trichloride was added. After a total heating time of 28 hours tests indicated that the -NCO groups of the isocyanate were almost completely reacted, and the reaction was judged finished. There were recovered 53 parts of citric acid urethane melting at 53° to 57° C.

In a high shear blender there was prepared a mixture containing 1 part deionized water and 1 part of a 25% aqueous solution of dimethyloctadecylamine acetate. To the mixture were added 1.82 parts of the ester prepared above and 0.91 part of methyl isobutyl ketone. The mixture was blended for 10 minutes, giving a dispersion containing 38.5% solids. The dispersion was diluted with water for use.

An aqueous dispersion containing 7.2% of the fluorinated urethane product was applied to yellow polyester shag carpet for the pill test and again to nylon carpet for repellency and dry soil resistance after the traffic test. The results are shown in Table II below. This application provided 0.29% solids on the nylon carpet, and 0.72% solids on the polyester carpet.

Example 3 and Comparisons

A 7.2% aqueous dispersion of fluorocitrate (V in Table I) was prepared as described in Example 2. Samples of polyester shag carpet treated with 10% (0.72% solids) of that dispersion based on carpet weight and 10% (0.89% solids) of a commercial fluoropolymer oil and water repellent were subjected to pill tests. Traffic and repellency tests were performed on nylon carpet treated with 4% (0.29% solids) of the ester dispersion based on carpet weight and 4% (0.36% solids) of the same commercial fluoropolymer oil and water repellent. The nylon applications were made by spraying, so that essentially all of the treatment dispersion was on the fiber surfaces. Results of these tests are shown as the last three entries in Table II below.

TABLE II

| Example No. or Comparison | Composition | CARPET TESTS: Pill Test: Char Length inches | Pill Test: Burn time minutes | Repellency Water/Oil: Initial | Repellency Water/Oil: After Traffic | Dry Soil Resistance: 10,000 Traffics |
|---|---|---|---|---|---|---|
| 2 | Citric acid urethane | 1.44 | 1.55 | 70/6 | 70/4 | 70 |
| 3 | Fluorocitrate | 0.73 | 1.53 | 70/6 | 70/4 | 70 |
| Comparison A | Fluoropolymer (commercial) | 1.94 | 2.08 | 90/6 | 50/3 | 50 |
| Comparison B | Water-treated Control | 0.76 | 1.63 | 0/0 | 0/0 | 50 |

The embodiments of the invention in which an exclusive property or privilege is claimed are defined as follows:

1. An aqueous dispersion of a composition consisting essentially of a perfluoroalkyl ester of a fluorinated alcohol having the formula $C_nF_{2n+1}$ $(CH_2)_m$ OH, wherein n is 6 to 14 and m is 2, and citric acid, the ester being volatile at about 200° C to 300° C, the composition forming up to about 60% of the total weight of the dispersion.

2. A dispersion according to claim 1 wherein the perfluoroalkyl ester is the citric acid urethane.

* * * * *